United States Patent [19]

Caruel et al.

[11] 4,246,758

[45] Jan. 27, 1981

[54] ANTIPOLLUTION COMBUSTION CHAMBER

[75] Inventors: Jacques E. J. Caruel, Dammarie les Lys; Philippe M. D. Gastebois, Melun, both of France

[73] Assignee: Societe Nationale d'Etude et de Construction de Moteurs d'Aviation, Paris, France

[21] Appl. No.: 937,929

[22] Filed: Aug. 30, 1978

[30] Foreign Application Priority Data

Sep. 2, 1977 [FR] France ..... 77 27038

[51] Int. Cl.[3] ..... F02C 7/22

[52] U.S. Cl. ..... 60/747

[58] Field of Search ..... 60/39.36, 39.65, 39.74 R

[56] References Cited

U.S. PATENT DOCUMENTS

| | | | |
|---|---|---|---|
| 3,132,483 | 5/1964 | Lefebvre | 60/39.36 |
| 3,934,409 | 1/1976 | Quillevere | 60/39.65 |
| 4,052,844 | 10/1977 | Caruel | 60/39.65 |
| 4,162,611 | 7/1979 | Caruel | 60/39.65 |
| 4,194,358 | 3/1980 | Stenger | 60/39.06 |

FOREIGN PATENT DOCUMENTS

| | | | |
|---|---|---|---|
| 1377988 | 9/1964 | France | 60/39.65 |
| 1150340 | 4/1969 | United Kingdom | 60/39.65 |

*Primary Examiner*—Robert E. Garrett

*Attorney, Agent, or Firm*—Bacon & Thomas

[57] ABSTRACT

The invention concerns a combustion chamber for turbojet engines. The combustion chamber is of the annular type and consists of two coaxial flame tubes opening into a common dilution and mixing zone. The inner tube is designed for low operating ratings of the engine, the outer tube for high ratings. Air is injected as far upstream as possible into the dilution zone, to enhance the homogenization of the gaseous flow issuing from the two tubes prior to their passage into the turbine and to assure the optimum radial distribution of temperatures. The combustion chamber according to the invention finds application in a particularly advantageous manner in turbojet engines used in aircraft propulsion because of the reduced emission of pollutants it affords.

5 Claims, 1 Drawing Figure

ANTIPOLLUTION COMBUSTION CHAMBER

BACKGROUND OF THE INVENTION

The present invention concerns a combustion device usable in gas turbines and is applicable particularly to aircraft turbojets because of the reduction in the proportions of pollutants said turbojet engines are permitted to emit, both at reduced and at higher ratings.

A combustion device for a gas turbine consists in a known manner of a housing, the upstream part of which forms a diffuser insuring the slowing of the air issuing from a compressor to an optimum value, and a combustion chamber or flame tube, placed within said housing. The invention more particularly concerns devices in which the flame tubes are of the annular type. Combustion reactions take place in the flame tubes and their essential role is to divide the airflow into at least three fractions; the combustion air, the dilution air and the air necessary to cool the walls of said flame tubes, the latter not participating in the combustion process. This division of the airflow leads to the definition in the flame tube, from upstream to downstream, of a primary zone or combustion zone and a secondary zone, designated the dilution zone, located downstream from the first zone.

The fuel is supplied to the chamber by injectors mounted at its base, i.e. upstream from the primary zone, said injectors insuring the atomization of the fuel by mechanical or aerodynamic means or its vaporization. Injectors of the aerodynamic type are for example represented by embodiments described in U.S. Pat. Nos. 3,915,387 and 3,937,011 in the name of the present applicant. With reference to the vaporizing device, please see U.S. Pat. Nos. 3,757,522 and 3,869,865, in the names of the present applicants.

The primary air supplied to the combustion chamber is introduced into said chamber in part through its base, and possibly the injectors, and in part transversely through orifices drilled through its walls.

Secondary air is introduced transversely, further downstream in the flame tube. It is generally introduced in a stepped manner by means of one or several series of holes distributed over its walls. The stepped introduction of secondary air prevents the overly rapid cooling of hot gases, which would prematurely block the reactions in progress.

In the combustion chambers the primary airflow is controlled so as to have the chamber operate at a given rating. The latter may consist of the maximum continuous rating, corresponding to the conditions of the cruising flight of a certain aircraft; it may also be the maximum rating attained at takeoff. The adjustment actually corresponds to the attainment of stoichiometric conditions in the combustion zone for the design rating, i.e. that the ratio of the mass flows of the fuel and of air be stoichiometric at this rating. The fact that the velocity of the reaction is at a maximum under stoichiometric conditions favors the attainment of complete combustion, with the exhaust gases containing only negligible quantities of pollutants, such as carbon monoxide (CO) or of partially burned hydrocarbons. It should be noted, however, that combustion under stoichiometric conditions favors the formation of nitrogen oxides ($NO_x$) because of the elevated temperatures attained.

Because of their design, combustion chambers used at the present time do not readily permit the achievement of a good compromise between the constraints of $NO_x$-CO pollution at low and high ratings; adaptation to a high rating results in a substantial emission of nitrogen oxides at this rating and leads to poor combustion conditions at low ratings, particularly when rolling on the ground, with the added consequence of substantial emissions of carbon monoxide and unburned hydrocarbons.

Designers are thus led to the adoption of compromise solutions in order to meet the standards imposed concerning maximum amounts of pollutants emitted during a standard cycle, of the type defined by the regulations presently elaborated, comprising various phases of the operation of the engine. It should be noted, however, that the pivoted regulations tend to impose even more severe limits, which cannot be satisfied by any of the engines currently in service. The engine manufacturers thus are searching for new solutions new chambers, designs which would meet the forthcoming requirements in the matter of maximum pollutant emissions. Various dispositions have been proposed and particularly the use of annular combustion chambers comprising two superposed modules, such as described in French Pat. No. 73.08819 issued to the present applicant and corresponding to U.S. Pat. No. 3,934,409. In this embodiment, one of the modules is a classic flame tube adapted to low ratings, while the other constitutes a chamber of the premixing type, functioning in the manner of a post-combustion chamber for high ratings. This type of chamber, however, requires delicate adjustment, first because of the risk of the flame ascending upstream of the high rating module and also then because of the problems of the mixing of the flows issuing from the two modules.

SUMMARY OF THE INVENTION

It is the object of the invention to provide another solution in which the combustion chamber is formed by two annular flame tubes or coaxial modules opening into a common dilution zone, into which the air is introduced as far upstream as possible. Each of the two modules is designed in a manner analogous to the combustion zone of a conventional flame tube. The heights of the two modules measured radially are similar, but their axial lengths are different so that each may be adapted to a certain rating.

According to the invention, the inner annular module is formed by an inner wall and an outer wall connected at their upstream ends by a base upon which are mounted the injectors which alone are supplied with fuel at idling. The inner module is adapted to idling, i.e. the air supplied to it allows the establishment of stoichiometric conditions for combustion at this rating. The length of this module is adapted so as to provide a dwelling time for the gases combustion gases in said module sufficient for the combustion reactions to be practically completed prior to the dilution taking place at its exit into the dilution zone common with that of the outer module. The air necessary the combustion is injected in part through the bottom of the module and the injectors and in part through a series of holes regularly distributed in each of the walls. The stepping of the introduction of air results in the establishment of a richer zone in the proximity of the injectors, which favors ignition under the unfavorable pressure and temperature conditions encountered during startup or during the reignition of a turbojet engine at high altitudes. To obtain good homogenization of the air/fuel mixture, it is preferable to use injectors of the aerodynamic type for the inner flame tube, which atomize the fuel conveniently even when the pressure at the entrance to the chamber is low. Additional staging of primary the introduction of air and improved homogenization of the mixture may be obtained by providing between each injector and the bottom of the chamber a flared intermediate section having a reduced volume compared with the combustion chamber, pierced by small diameter orifices in regular distribution, allowing the introduction of a small fraction of combustion air in the form of penetrating jets, generating high turbulence immediately downstream from the injector device.

All of the dispositions aimed at increasing the dwell time in the inner flame tube and improving the distribution of the fuel in it at low ratings, lead, on account of the adaptation of the inner flame tube, to a reduction to a minimum of the carbon monoxide and unburned hydrocarbon emissions at these speeds.

The outer module, which is coaxial with the inner module, has a shorter length measured axially than the inner module, and its base is located downstream with respect to the base of the latter. The outer module is designed for high ratings of the engine, for example, for cruising or takeoffs.

The air supplied to said outer module at the selected design rating thus forms a stoichiometric mixture with the fuel introduced by the injectors mounted on its base, said injectors being fed with the fuel at this design rating. The outer module consists of an external annular wall and an internal annular wall, the downstream end of the latter being connected to the downstream end of the external wall of the inner module. The walls of the outer tube are connected at their upstream ends to a base upon which the injectors are mounted. The air required for combustion is provided by the injectors and by orifices regularly distributed in a circular arrangement over the two walls.

The use of prevaporizing injectors may be contemplated for this module. The conditions of temperature, pressure and stoichiometry under which combustion for this module takes place provide an advanced state of combustion in said module prior to the entry of the gases in the common dilution zone.

Due to the reduced length of the outer module, the dwell time there of high temperature gases is reduced to a minimum, said gases being rapidly mixed with the cold air injected in the upstream part of the common dilution zone, the reactions resulting in the formation of nitrogen oxides thus being very promptly interrupted. An annular space is provided between the two modules so as to permit the circulation of air between said modules with a view particularly to supplying air to the orifices provided in the respective walls of the two modules. The walls of the two modules may be protected thermally by cooling films or other known means.

The common dilution and mixing zone is formed by an extension of the external wall of the outer module and of the internal wall of the inner module downstream of the junction of their respective internal and external walls. Dilution orifices are formed in the two walls of the mixing zone as far downstream as possible, in the vicinity of the upstream ends of each module. These orifices are distributed in a regular manner on coplanar circles and they permit the injection of air in the form of penetrating jets, which create a substantial turbulence in the mixing zone. This arrangement essentially serves the purpose of preventing the stratification of the flows issuing from the two modules and thus improve the temperature distribution at the exit of the chamber so that excessive temperatures will not be attained at the tips of the turbine blades at maximum ratings, in view of the relative position of the two modules. In addition, the diluting role played by the flow of air issuing from the outer module during idling should be noted. The inner module is equipped with an ignition device to restart combustion at low ratings.

In a preferred embodiment, injection takes place exclusively in the outer module during high ratings, the fuel supply to the inner module being interrupted after combustion is established in the outer module. It should be understood that the transition from idling to high ratings operations may take place by supplying fuel to the outer module progressively, whereby the fuel supply to the inner module is reduced simultaneously.

The diffuser which constitutes the upstream part of the chamber casing may advantageously be divided by an annular, streamlined body which is intended to distribute the flow of air issuing from the compressor between the two modules.

BRIEF DESCRIPTION OF THE DRAWINGS

The description given herebelow with reference to the drawing attached hereto, will serve for a better understanding of the illustrated embodiment of the combustion device of the invention.

The single FIGURE represents a semisectional view along a plane passing through the axis of symmetry of said combustion device.

DESCRIPTION OF A PREFERRED EMBODIMENT

Figure 1:
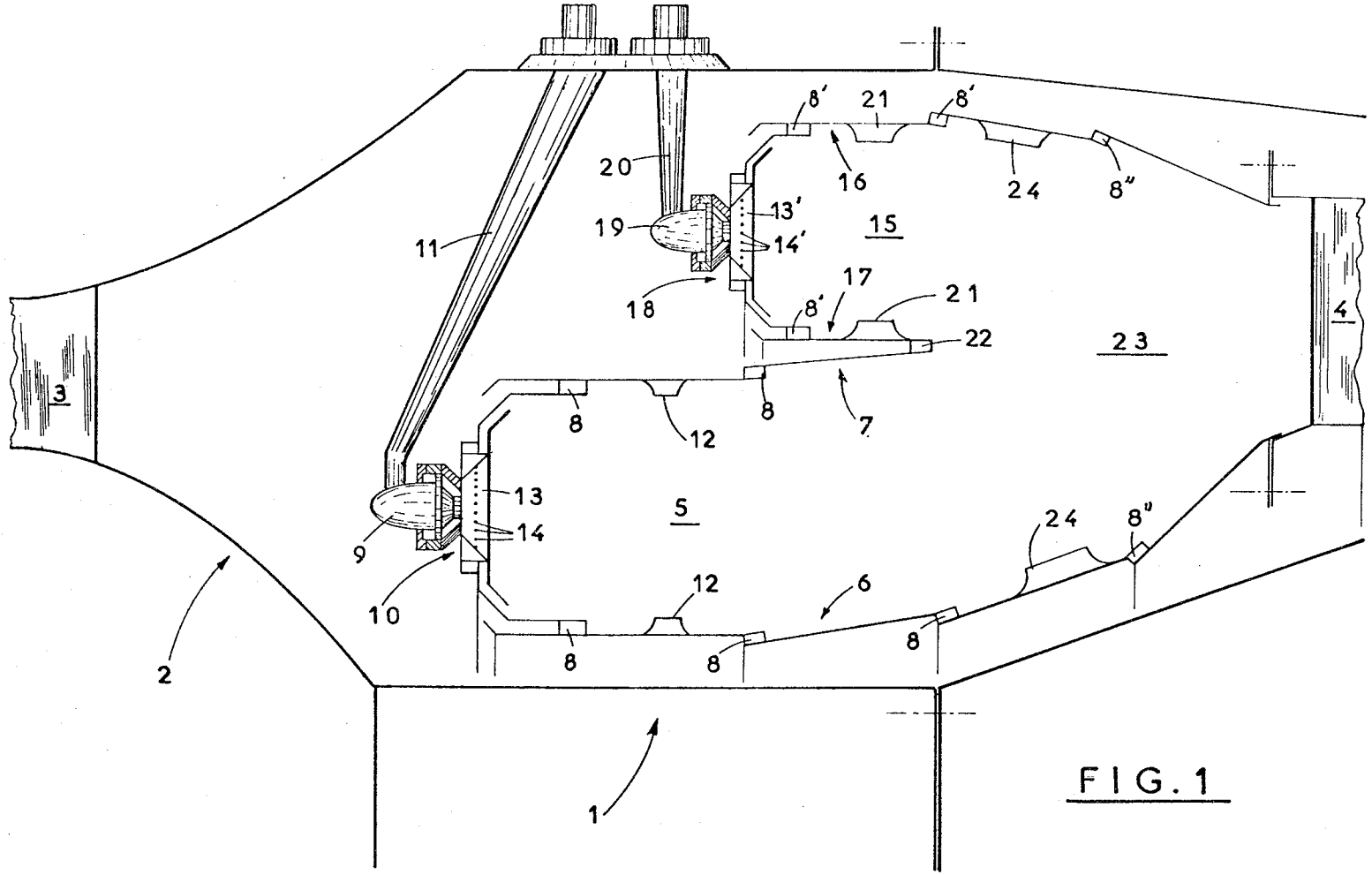

The coaxial walls of the housing 1 are formed by annular rings connected to each other and forming upstream a diffuser 2 conducting the air issuing from the compressor at an optimal velocity. The reference 3 indicates a vane of an guide ring. A turbine inlet guide assembly is arranged at the downstream end of the casing, one vane of which being shown at 4.

The combustion chamber proper is formed by two annular, coaxial flame tubes or modules, being of essentially equal height as measured on a radius of the chamber and opening into a common dillution zone. The inner module 5 is designed to operate at idling and to limit polluting emissions to a minimum at such ratings. It comprises an annular internal wall 6 and an annular external wall 7. These may be formed, for example, in a known manner by a succession of rings of sheet metal providing between themselves the passages 8, intended to introduce air for the cooling films. The injectors 9 mounted on the base 10 insure the aerodynamic atomization of the fuel supplied to them by the tubing 11 connected with a suitable fuel supply system.

The air required the combustion is introduced into the module through these injectors, in which it assures the atomization of the fuel, by means of orifices formed in the base 10 in the vicinity of the injectors, and by the orifices 12 in the form of nozzles penetrating the walls. The orifices 12 play the same role as the primary orifices of a combustion chamber of the conventional type, their number on each wall being in general twice that of the injectors. The orifices 12 are distributed in two coplanar rows, one on each wall of the tube, the distance measured axially between the plane of the injectors and that containing the rows of orifices being between 0.9 times and 1.2 times the half height of the flame tube, measured radially.

As shown in the FIGURE, the injectors 9 are mounted on a flared, intermediate section 13, with a lesser volume than the combustion chamber, said section being pierced by the holes 14. Part of the primary air may thus be injected in the vicinity of the injector in the form of high velocity jets, which by enhancing local turbulence favor the homogenization of the air fuel mixture.

A conventional type ignition device, not shown, is installed in the module 5. The air necessary for dilution is injected downstream of the module 5 in the common dilution zone. The concept of the module 5 operating at idling leads to a substantial reduction in carbon monoxide and unburned hydrocarbon emissions, due to the length of the module and to the stoichiometric conditions prevailing at the design rating, which assure longer dwell times and thus the completion of the reactions, to the progressive manner of the introduction of air and the quality of fuel distribution resulting from the type of injector chosen.

The outer flame tube 15 is much shorter than the module 5 and its volume is smaller than that of the latter. It is designed to achieve combustion under stoichiometric conditions with dwell times as short as possible, for sustained operation at, the selected design rating, i.e. cruising or takeoff, as the case may be. It comprises an external wall 16 and an internal wall 17, attached to a base 18, upon which the injectors 19 are mounted in a regular distribution. Said injectors may be of the aerodynamically atomizing type, as shown, or of the prevaporizing type. The tubing 20 provides for the distribution of fuel to the injectors 19 from a fuel supply device of the conventional type. The walls 16 and 17 are formed in a known manner for example by sheet metal sleeves, protected against high temperatures by cooling films of air forming in the passages such as 8'. The air required for the combustion is introduced in the module 15 by through its injectors, in which said air participates in the atomization of the fuel, through orifices formed in the base 18 (not shown) and through the orifices 21 formed in the walls. In the FIGURE attached hereto, the injectors 19 of the outer module, as those of the inner module, are mounted on a flared, intermediate section 13', having a lesser volume than the chamber, orifices 14' of small dimensions being provided in said intermediate part.

The orifices 21 are analogous to the primary orifices of a chamber of conventional type and their characteristics will not be recited here, having been enumerated hereabove. The orifices 21 are pierced relatively upstream in the zone 15, in order to prevent the formation of excessively rich zones in which the temperature attained would favor the formation of nitrogen oxides. To accelerate the introduction of the air required for combustion in the module 15 even more, the air may be introduced solely through the orifices 14' of the intermediate section 13' and through the injectors, the holes 21 being eliminated in this case. The design applied to the module 15 has the purpose of reducing the dwell time of the gases at elevated temperatures, due to the reduced length of the module and the dilution which therefore takes place very rapidly in the common mixng zone. The conditions of temperature pressure prevailing in the module 15 at high ratings permit the achievement of the reactions in spite of the reduced length of said module and thus the attainment of low emission indices for carbon monoxide and unburned hydrocarbons.

The internal wall 6 of the inner tube 5 and the external wall 16 of the outer tube 15 extend downstream from the junction 22 of the external wall 7 and internal wall 17, respectively, to form a common zone of dilution and mixing at 23. A device is provided at the junction 22 to insure the passage of cooling air into said common zone. The walls of the zone 23 are also formed by sheet metal sleeves, in which passages such as 8'' are arranged for the passage of air to form cooling films.

Orifices 24, in the form of nozzles, are regularly distributed over the two walls of the zone 23, as far upstream as possible, so as to introduce air into said zone in the form of jets, which in turn generates a substantial turbulence. This arrangement achieves the dilution of the flows issuing from the modules 5 and 15 immediately downstream from their opening into the zone 23. The orifices 24 are distributed over two circular rows, one on each wall, located approximately on a transverse plane and their axes converge upstream in the zone 23.

The dilution achieved by the air injected through the holes 24 leads to the homogenization of the gas flows issuing from the modules 5 and 15. This is particularly important at high ratings of operation where only the module 15 is operating; under these conditions the substantial stirring effect produced by the air of dilution introduced into the mixing zone prevents the stratification of the flows issuing from the modules 5, and 15, which would result in excessive heating of the tips of turbine blades, in view of the relative disposition chosen for the two modules.

Concerning the diffuser 2, it may be equipped with an annular, streamlined body assuring the distribution of the flow of air issuing from the compressor between the modules 5 and 15, thus improving the quality of the flow. The interposition of a streamlined body of a suitable form in the diffuser makes it possible specifically to divide a diffuser with a large apex angle into two superposed, low apex angle diffusers, which prevents the separation of the flow from the walls and the formation of vortices. The distribution of the flow of air issuing from the compressor between the two modules will depend on the type of turbojet engine in which the chamber is installed and the characteristics of its operating cycle. For an engine intended for a supersonic transport aircraft, the distribution of the flow may take place, for example, in the following manner:

35% for the cooling devices of the walls of the modules and the mixing zone, introduced through devices such as 8, 8', 8'', 5 to 6% for the injectors of module 5, 15% for the injectors of module 15, the rest is distributed in the same proportions as for the injectors between the primary holes 12 and 21 of the modules 5 and 15.

A combustion device according to the invention should therefore meet the established pollution standards, with the design of its cruising module assuring complete combustion with low nitrogen oxide emissions due to reduced dwell times and early dilution and the design of the low speed module favoring the completion of the reactions at low ratings, because of extended dwell times, prior to the onset of dilution. The relative arrangement of the two modules facilitates the installation or removal of the injectors and a simplified disposition of the fuel supply tubing. The presence of the diluting orifices in a common mixing zone insures the homogenization of gaseous flows issuing from the two modules and this function is essential at high ratings to prevent stratification which would lead to excessive heating of the tips of turbine blades.

We claim:

1. A combustion device for a turbojet engine, comprising: an annular casing, the upstream part of said casing defining a diffuser for air issuing from a compressor, two annular, coaxial flame tubes, located in the casing, with their radial heights being approximately the same, while their axial lengths differ, each tube consisting of an internal annular wall and an external wall, secured at their upstream ends to a base upon which fuel injectors are mounted, the external wall of the inner tube and the internal wall of the outer tube being connected to form a junction at their downstream ends, the external wall of the outer tube and the internal wall of the inner tube extending past said junction to define a common dilution and mixing zone for the gaseous flows emanating from the two tubes, the axial length of the inner tube being sufficient to permit the achievement of combustion reactions prior to the entry of the gases in the common dilution and mixing zone, the injectors of the inner tube being mounted on the base of said tube by the intermediary of a flared member of less volume than the tube, a large number of small orifices being formed in said intermediate member, allowing the injection of a portion of the air necessary for combustion in the immediate vicinity of the injector, the outer tube having an axial length less than that of the inner tube with its base being located downstream with respect to the base of the inner tube, said common dilution and mixing zone having on the upstream part of its walls orifices regularly distributed in coplanar rows, effecting the injection of a flow of air to assure the homogenization of the gaseous flows emanating from the two tubes.

2. A combustion device according to claim 1, wherein the air required for combustion is introduced in the outer tube through orifices formed in its base, and by its injectors.

3. A combustion device according to claim 1, wherein the air required for combustion is introduced into the outer tube through orifices formed in the base of said tube, by its injectors and transversely through orifices formed in its walls and distributed regularly in coplanar rows.

4. A combustion device according to claim 1 wherein the injectors used to introduce fuel into the outer tube are of the aerodynamic atomizing type.

5. A combustion device according to claim 1 wherein in the entrance diffuser, an annular profiled body is disposed, said body assuring the proper distribution of air flow between the two flame tubes.

* * * * *